US005380447A

United States Patent [19]

Kirk et al.

[11] Patent Number: 5,380,447

[45] Date of Patent: Jan. 10, 1995

[54] PROCESS AND FABRIC FINISHING COMPOSITIONS FOR PREVENTING THE DEPOSITION OF DYE IN FABRIC FINISHING PROCESSES

[75] Inventors: Thomas C. Kirk, Langhorne; Curtis Schwartz, Ambler; Barry Weinstein, Dresher, all of Pa.

[73] Assignee: Rohm and Haas Company, Philadelphia, Pa.

[21] Appl. No.: 90,605

[22] Filed: Jul. 12, 1993

[51] Int. Cl.[6] ..... D06M 13/256; D06M 13/184

[52] U.S. Cl. ..... 252/8.6; 252/8.7; 252/8.9; 8/442; 8/115.51; 8/194

[58] Field of Search ..... 252/8.6, 8.7, 8.8, 8.75, 252/8.9; 8/442, 115.51, 194

[56] References Cited

U.S. PATENT DOCUMENTS

| | | | |
|---|---|---|---|
| 2,205,887 | 6/1940 | Kern | 8/442 |
| 4,005,029 | 1/1977 | Jones | 252/99 |
| 4,006,092 | 2/1977 | Jones | 252/95 |
| 4,079,028 | 3/1978 | Emmons et al. | 260/29.6 |
| 4,155,892 | 5/1979 | Emmons et al. | 8/1 R |
| 4,218,220 | 8/1980 | Kappler et al. | 8/102 |
| 4,351,754 | 9/1982 | Dupré | 524/445 |
| 4,384,096 | 5/1983 | Sonnabend | 326/313 |
| 4,388,077 | 6/1983 | Ruck | 8/138 |
| 4,425,469 | 1/1984 | Emmons et al. | 524/750 |
| 4,531,946 | 7/1985 | Christie et al. | 8/442 |
| 4,740,213 | 4/1988 | Ricci | 8/106.1 |
| 4,832,864 | 5/1989 | Olsen | 252/174.12 |
| 5,240,771 | 8/1993 | Brueckmann et al. | 252/8.7 |

FOREIGN PATENT DOCUMENTS

| | | |
|---|---|---|
| 341205 | 11/1989 | European Pat. Off. . |
| 508034 | 10/1992 | European Pat. Off. . |
| 508358 | 10/1992 | European Pat. Off. . |
| 538228 | 4/1993 | European Pat. Off. . |
| 24210 | 12/1982 | Germany . |
| 3124210 | 12/1982 | Germany . |
| 9306202 | 4/1993 | WIPO . |

OTHER PUBLICATIONS

Jagher, H. U. "Mode of Action of Polymers with Dye Transfer Inhibiting Properties," Tenside, Surfactants, Deterg. 28 (6), pp. 428–433 (1991).

*Primary Examiner*—Mark L. Bell
*Assistant Examiner*—C. M. Bonner
*Attorney, Agent, or Firm*—Marc S. Adler

[57] ABSTRACT

This invention provides a process for preventing dye from depositing onto fabric, and fabric finishing compositions useful in the dye deposition inhibiting process of this invention. Specifically, a process is provided where 1) an aqueous bath is formed comprising a) water, b) dyed fabric, and c) a dye deposition inhibiting agent, 2) the dyed fabric is treated in the aqueous bath and the fabric releases a portion of the dye from the dyed fabric into the bath, and 3) the dye inhibiting agent is maintained in contact with the dyed fabric for the duration of the treating step. The dye deposition inhibiting agent is added to the process as a fabric finishing composition comprised of at least 0.1 wt % dye deposition inhibiting agent.

21 Claims, No Drawings

PROCESS AND FABRIC FINISHING COMPOSITIONS FOR PREVENTING THE DEPOSITION OF DYE IN FABRIC FINISHING PROCESSES

FIELD OF INVENTION

This invention relates to fabric finishing compositions and a process for preventing dye from depositing onto fabric. More specifically, this invention relates to adding one or more water soluble or water dispersible compounds to stonewashing and prewashing processes to prevent dyes from depositing on the fabric.

BACKGROUND OF INVENTION

Clothing made from cellulosic fabrics such as cotton and in particular indigo dyed denim have been common for many years. Recently, consumers have preferred the denim to look preworn and feel softer. This preworn look and softer feel can be accomplished by fabric finishing processes such as prewashing or stonewashing where the fabric is treated to release dye from the fabric. In this invention, we define a "fabric finishing process" as any process which includes one or more steps where dye is released from fabric or clothing.

The most common dye used to dye denim is indigo blue which is classified as a vat dye. Indigo blue is the most common dye that is released in a stonewashing or prewashing process. Other dyes, such as sulfur black are also used to color denim and could also be released in a fabric finishing process.

Prewashing the fabric can accomplish one or more of the following effects: 1) uniform fading of the fabric by bleeding excess dye, 2) softening the fabric by removing sizing, a stiffening agent used to facilitate cutting the fabric, 3) preshrinking the fabric, and 4) improving the hand of the fabric.

A typical fabric prewashing process, for example, may begin with a 15 to 20 minute wash cycle using a conventional alkaline laundry detergent formula, followed by a souring rinse to remove alkalinity developed by the detergent, a fresh water rinse, a fabric softening rinse, and a water extraction cycle. A typical laundry detergent may contain, for example, nonionic and ionic surfactants, builders, soil anti-redeposition agents, optical brighteners, and fillers. Several variations in this prewashing process have been made. For example, U.S. Pat. No. 4,388,077 describes the use of an amphoteric surfactant and builder in a detergent composition to improve preshrinking, dye-bleeding, and fabrics softening results. Alternatively, U.S. Pat. No. 4,218,220 adds an additional bleaching step after the wash cycle. Specifically, this additional step consists of contacting the fabric or clothing with an aqueous solution containing bleach and fabric softener to produce a more uniform fade. In the present invention, we define the term "prewashing" to include those processes which uniformly fade the fabric.

Stonewashing the fabric or clothing accomplishes the following effects: 1) non uniformly fades the fabric such that the color density in the fabric varies throughout the fabric, 2) softens the fabric, 3) makes the fabric surface appear fuzzy. The stonewashing process in contrast to the prewashing process produces a more preworn look.

The stonewashing process traditionally involves contacting wetted denim clothing in large tub equipment with pumice stones having a particle size of about 1 to 10 inches and with smaller pumice particles generated by the abrasive nature of the process. The pumice abrades the fabric producing in the denim localized areas of lighter color and similar lightened areas in the seams. Additionally, the pumice softens the fabric and produces a fuzzy surface similar to that produced by extended wear of the fabric. One or more chemicals may be included with the pumice stones, such as for example surfactant, bleach, and builders. Additionally, other abrasive materials can be used instead of the pumice such as ceramic balls used in ball mills, and irregular hard rubber pieces. After the washing step, the fabric or clothing is typically rinsed one or more times in an aqueous solution. The aqueous solution may include such additives as fabric softeners, or neutralizing agents.

As with the prewashing process, variations of the stonewashing process have been reported. U.S. Pat. No. 4,740,213 discloses a dry method for stonewashing where pumice, impregnated with a chemical bleaching agent, is brought into contact with the fabric to produce a more random faded look. Following dry contact of the fabric or clothes with the pumice stones, the fabric is rinsed with an aqueous solution to neutralize the bleach. Another variation to the stonewashing process is disclosed in U.S. Pat. No. 4,832,864 where a detergent composition containing cellulase enzymes is used instead of an abrasive like pumice to degrade and non uniformly fade the fabric. Also, cellulase enzymes may be used in combination with pumice stones and optionally other chemicals such as surfactants, builders, buffering agents to produce a preworn look and feel. In the present invention, we define "stonewashing" as a process that produces a nonuniform fading of the fabric.

Unfortunately, during fabric finishing processes, these released dyes can deposit back onto the denim and white pocket liners. Because of this deposition, the pocket liners become undesirably colored and the denim has a darker appearance on the seams of the clothing. Fabrics may-also appear "blotchy" meaning that certain locations on the fabric may appear darker or lighter than other locations on the same fabric. Neither colored pocket liners, nor darkened seams and threads, nor blotchy fabric are acceptable. DE 3124210 A-1 discloses a liquid detergent composition containing a surfactant and a polymer that is effective for preventing dye transfer during laundry operations. However, DE 3124210 A-1 does not address the problem of preventing dye deposition in a fabric finishing process specifically designed to release dye from the fabric. The problem of dye deposition in stonewashing and prewashing is more severe because the concentration of dye in the wash bath is at least 100 percent higher than in a typical household laundry process. Consequently, a fabric finishing process and dye deposition inhibiting agents are needed that will be effective in preventing dye from depositing on fabric under these stressed conditions.

Accordingly, one aspect of this invention is to provide fabric finishing compositions containing one or more dye deposition inhibiting agents which can be added during fabric finishing processes to effectively inhibit the deposition of dye during these processes.

A further aspect of this invention is to provide a process to inhibit the deposition of released dyes during prewashing or stonewashing.

SUMMARY OF THE INVENTION

A process is disclosed for preventing the deposition of a dye onto a fabric comprising:

1) forming an aqueous bath comprising
   a) water,
   b) dyed fabric, and
   c) a dye deposition inhibiting agent,
2) treating the dyed fabric in the aqueous bath and releasing a portion of the dye from the dyed fabric into the bath, and
3) maintaining the dye deposition inhibiting agent in contact with the dyed fabric and released dye for the duration of the treating step, the dye inhibiting agent in the aqueous bath being maintained at a concentration of from at least 25 ppm to about 2000 ppm based on the total weight of the aqueous bath excluding the weight of the dyed fabric.

The dye deposition inhibiting agent is selected from the following classes of compounds:

i) an aqueous system thickener,
ii) an aryl sulfonic acid condensate,
iii) a polycarboxylic dispersant and,
iv) an acrylamide containing polymer.

Furthermore, fabric finishing compositions are disclosed comprised of at least 0.1 weight percent dye deposition inhibiting agent. The fabric finishing compositions useful in the present invention are added to fabric finishing processes such as stonewashing and prewashing processes in any step of the process where fabric will be in contact with released dye in an aqueous bath.

DETAILED DESCRIPTION OF THE INVENTION

We have discovered that certain water soluble and water dispersible compounds, referred to hereinafter as "dye deposition inhibiting agents", prevent dye, which is intentionally or unintentionally released in a fabric finishing process, from depositing onto previously dyed fabric and white or lightly colored fabric such as pocket liners. One or more dye deposition inhibiting agents are added to a fabric finishing process as fabric finishing compositions as defined herein. A dye deposition inhibiting process, fabric finishing compositions, and dye deposition inhibiting agents are described below.

DYE DEPOSITION INHIBITING PROCESS

Generally, the fabric finishing compositions, which contain the dye deposition inhibiting agents, are used in any step of the fabric finishing process where dye is intentionally or unintentionally released from fabric into an aqueous solution containing the fabric. This aqueous solution containing the fabric being treated is herein called the "bath" or "aqueous bath".

For example, fabric finishing compositions may be added to any of the stonewashing process steps where dye may be released in the bath such as for example in 1) one or more wash steps where the "stonewashed" look may be achieved through agitating the fabric or clothing in the bath containing additives such as pumice stones and cellulase enzymes optionally combined with one or more chemicals such as a bleaching agent, surfactant, builder, or buffering agent 2) in one or more neutralization steps where the fabric or clothing may be agitated in the bath to neutralize the fabric or clothing or to remove excess bleach, and 3) in one or more rinse steps where the fabric or clothing may be agitated in the bath to remove residual chemicals. The fabric finishing compositions useful in this invention may also be added to any other step in the stonewashing process where dye is released into the bath.

Similarly, fabric finishing compositions may be added to any of the prewashing process steps where dye may be released into the bath, such as for example in 1) one or more wash steps where the fabric or clothing is agitated in the aqueous bath containing one or more additives such as surfactant, builder, solvent, inert diluent, and bleach to prewash the fabric or clothing, 2) in one or more neutralization steps where the fabric or clothing may be agitated in the bath to neutralize the fabric or clothing or to remove excess bleach, 3) one or more fabric softening steps where the fabric or clothing is agitated in the bath containing a fabric softener to soften the fabric or clothing, and 4) one or more rinse steps where the fabric or clothing is agitated in the bath to remove residual chemicals from the clothing or fabric. The fabric finishing compositions useful in this invention may also be added to any other step in the prewashing process where dye is released into the bath.

Generally, in a fabric finishing process, to inhibit the deposition of dye, more dye deposition inhibiting agent is needed at a low bath pH than at a high bath pH. For example, the total level of dye deposition inhibiting agent in a bath having a pH from about 3 to about 7 should be at least 50 ppm based on the total weight of the bath, excluding the weight of the fabric. Also, for example, the total level of dye deposition inhibiting agent in a bath having a pH from about 7.1 to about 13 should be at least 25 ppm based on the total weight of the bath, excluding the weight of the fabric. Preferably, the level of dye deposition inhibiting agent in the bath is at least 250 ppm based on the total weight of the bath, excluding the weight of the fabric. Additionally, one or more dye deposition inhibiting agents may be added to the bath for a total maximum level of about 2000 ppm based on the total weight of the bath, excluding the weight of the fabric.

Typically, the order of addition in the fabric finishing process is to add to a household, industrial, or institutional washing machine according to machine maximum capacity instructions 1) the fabric or clothing items, 2) the water, and 3) the fabric finishing composition. However, it is theoretically possible to reverse the order of the steps and for dye deposition inhibition there is no preferred order of addition. For example, the water and fabric finishing composition may be added first, followed by adding the fabric second. A second alternative is the fabric and water may be added first, followed by adding the fabric finishing composition second. A third alternative is the fabric finishing composition may be added first, followed by adding the fabric second, and then adding the water. Finally, the fabric, water, and fabric finishing composition may be added simultaneously. Optionally, additional fabric finishing composition may be added after the wash cycle has started.

After adding the fabric, water, and fabric finishing composition to the machine, the fabric is then agitated in the bath. The degree of agitation required is that degree which is sufficient to bring the dye deposition inhibiting agent in contact with the fabric and in contact with any released dye in the bath. The amount of time required for contact of the dye and fabric with the dye deposition inhibiting agent is that time necessary to release the desired amount of dye from the fabric. For example, in the stonewashing process, the wash cycle may take from about 30 to 60 minutes to release the desired amount of dye. In the prewashing process, the wash cycle for example may take from about 15 to about 30 minutes to complete. The contacting of the dye deposition inhibiting agent with the fabric and released dye prevents the dye from depositing on the fabric during the wash cycle.

Following one or more wash cycles, one or more fabric finishing compositions useful in this invention may also be added to the bath which contains an aqueous solution for treating the fabric or cloth where dye may be unintentionally released into the bath. For example, the fabric finishing compositions may be added to a bath which contains an aqueous solution for such steps as neutralizing, rinsing, or fabric softening the fabric. As with the wash step, the dye deposition inhibiting agent is contacted with the fabric and released dye in the bath by agitating the bath. The amount of time required for contacting the released dye and fabric with the dye deposition inhibiting agent is that time necessary to complete the fabric finishing step. For example, in a rinse step, the necessary contact time, would be that time necessary to remove residual chemicals from the fabric, and may be for example from about 5 to 20 minutes. Similarly, in a fabric softening step, the necessary contact time to inhibit the deposition of dye would be that time necessary to soften the fabric and may be for example from about 5 to 30 minutes. The contacting of the dye deposition inhibiting agent with the fabric and dye in the bath, prevents the dye from depositing on the fabric in steps where the dye is unintentionally released into the bath.

The fabric finishing compositions, which contain the dye deposition inhibiting agents, are effective in inhibiting dye deposition for temperatures ranging from about 5° C. to about 95° C. Additionally, the fabric finishing compositions of this invention are effective in preventing the deposition of dye at bath pH levels ranging from about 3 to 13.

FABRIC FINISHING COMPOSITIONS

The dye deposition inhibiting agents may be added to the fabric finishing process as a fabric finishing composition. Fabric finishing compositions are composed of either 1) 100 wt % solid dye deposition inhibiting agent (including reaction impurities), or 2) 0.1 to 45 wt % dye deposition inhibiting agent and one or more of the following additives: water, solvent, builder, surfactant, inert diluent, buffering agent, bleach, cellulase enzyme, stabilizer, perfume, fabric softener, preservatives, and opacifiers.

Builders

Fabric finishing compositions may contain 0 to about 85 percent by weight of one or more builders. Examples of builders which may be used in fabric finishing compositions include zeolites, sodium carbonate, low molecular weight poly(carboxylic acids), nitrilotriacetic acid, citric acid, tartaric acid, the salts of aforesaid acids, and monomeric, oligomeric or polymeric phosphonates, such as orthophosphates, pyrophosphates and especially sodium tripolyphosphate. A more extensive list of suitable builders is found in U.S. Pat. No. 4,832,864. Preferably the fabric finishing compositions are substantially free of phosphates.

Surfactants

Fabric finishing compositions may include from 0 to about 50 percent by weight of one or more surfactants. Nonionic, anionic, cationic, and amphoteric surfactants may be included in the fabric finishing composition.

Nonionic surfactants are surfactants which have no charge when dissolved or dispersed in aqueous solutions. Typical nonionic surfactants include for example, from $C_6$ to $C_{12}$ alkylphenol ethoxylates, from $C_{12}$ to $C_{20}$ alkanol alkoxylates, and block copolymers of ethylene oxide and propylene oxide. Optionally, the end groups of polyalkylene oxides can be blocked, whereby the free OH groups of the polyalkylene oxides can be etherified, esterified, acetalized and/or aminated. Another modification consists of reacting the free OH groups of the polyalkylene oxides with isocyanates. The nonionic surfactants also include $C_4$ to $C_8$ alkyl glucosides as well as the alkoxylated products obtainable therefrom by alkoxylation, particularly those obtainable by reaction of alkyl glucosides with ethylene oxide.

Anionic surfactants are surfactants having a hydrophilic functional group in a negatively charged state in an aqueous solution. Commonly available anionic surfactants include carboxylic acids, sulfonic acids, sulfuric acid esters, phosphate esters, and salts thereof.

Cationic surfactants contain hydrophilic functional groups where the charge of the functional groups are positive when dissolved or dispersed in an aqueous solution. Typical cationic surfactants include for example amine compounds, oxygen containing amines, and quaternary amine salts.

Amphoteric surfactants contain both acidic and basic hydrophilic groups and can be used in fabric finishing compositions.

Generally, nonionic surfactants, such as alcohol ethoxylates are preferred for use in the fabric finishing compositions of this invention.

Solvents and Inert Diluents

Solvents and inert diluents may be used in fabric finishing compositions for dissolving or dispersing the dye deposition inhibiting agent. Typical solvents which may be used include oxygen containing solvents such as alcohols, esters, glycol, and glycol ethers. Alcohols that may be used in the present compositions include for example methanol, ethanol, isopropanol, and tertiary butanol. Esters which may be used include for example amyl acetate, butyl acetate, ethyl acetate, esters of glycols. Glycols and glycol ethers that are useful as solvents include for example ethylene glycol, propylene glycol, and oligomers of ethylene or propylene glycol. Solid fabric finishing compositions may also contain an inert diluent such as sodium sulfate, sodium chloride, or sodium borate, or selected polymers such as polyethylene glycol or polypropylene glycol.

Buffering Agents

The fabric finishing compositions may contain 0 to about 50 weight percent of one or more alkali metal salts selected from the following compounds: silicates, carbonates, and sulfates. Also, the fabric finishing composition may also contain organic alkalis such as triethanolamine, monoethanolamine, and triisopropanolamine.

Solid Forming Agents

The fabric finishing compositions of this invention can be formulated in a solid form such as a cast solid, granule or pellet. Such solid forms are typically made by combining the dye deposition inhibiting agent with a solidification agent and forming the combined material in a solid form. Both inorganic and organic solidification agents can be used. The solidification agents must be water soluble or dispersible, compatible with the dye deposition inhibiting agents, and easily used in the manufacturing equipment. Inorganic solid forming agents which may be used are hydratable alkali metal or alkaline earth metal inorganic salts that can solidify through hydration. Such solid forming agents include for example sodium, potassium, or calcium carbonate, bicarbonate, tripolyphosphate silicate, and other hydratable salts. Organic solidification agents typically include water soluble organic polymers such as polyethylene oxide or polypropylene oxide having a molecular weight greater than about 1000. Other water soluble polymers that can be used include polyvinyl alcohol, and polyalkyl oxazolines.

Other common additives in fabric finishing compositions are bleaching agents, used in an amount of up to 30 percent by weight, and corrosion inhibitors, such as silicates, used in an amount of up to 25 percent by weight. Suitable bleaching agents which may be used are for example, perborates, percarbonates or chlorine-generating substances, such as chloroisocyanurates. Suitable corrosion inhibitors which may be used are, for example, sodium silicate, sodium disilicate and sodium metasilicate.

The fabric finishing composition may also contain up to about 5 percent by weight of adjuvants such as a anti-bacterial agents. Other common additives optionally used are optical brighteners, enzymes, perfumes, and fabric softeners. Fabric softeners typically include quaternary ammonium salts such as for example ditallowdimethylammonium chloride.

Liquid fabric finishing compositions typically include in addition to the dye deposition inhibiting agent at least an organic solvent or water, while solid fabric finishing compositions typically include in addition to the dye deposition inhibiting agent at least a surfactant, and a builder. Solid fabric finishing compositions useful in the present invention may be in any of the several physical forms, such as powders, beads, flakes, bars, tablets, noodles, pastes, and the like.

Other additives that may be formulated into the fabric finishing composition will depend on the step in the fabric finishing process for which the deposition of dye must be inhibited. For example, in the step which actually produces the stonewashed look, cellulase enzyme may be included in the fabric finishing composition to produce a "stonewashed" look as described in U.S. Pat. No. 4,832,864. Or for example, a fabric finishing composition added to the wash cycle of a prewashing process may include a surfactant. Alternatively, a fabric softener may be added to the fabric finishing composition in a rinse step to soften the fabric.

The fabric finishing compositions described above are effective in preventing the deposition on fabric of dye dissolved or dispersed in an aqueous bath. Accordingly, the composition may be added during one or more steps in the fabric finishing process as described previously, where dye may be released into the bath.

DYE DEPOSITION INHIBITING AGENTS

Dye deposition inhibiting agents that have been found to be effective in the process of this invention include known thickeners and dispersants.

Thickeners that are effective in the present invention include organic, nonionic and anionic, water soluble and water swellable polymers, that are useful in aqueous systems such as latex paints. "Thickeners" as used herein are either associative or nonassociative types. "Associative thickeners" are water soluble or water swellable polymers that have chemically attached hydrophobic groups which are capable of hydrophobic associations. The attached "hydrophobic groups" are defined as any chemical group which promotes water insolubility and are typically alkyl or alkaryl groups containing from about 4 to about 30 carbon atoms. "Nonassociative thickeners" are water soluble or water swellable polymers that do not have chemically attached hydrophobic groups.

Preferable thickeners for use in the fabric finishing compositions and process include one or more of the following types:

i) a polyethoxylated urethane, and ii) an acrylic carboxylate emulsion polymer.

In addition to the thickeners, certain dispersants for aqueous systems are also effective in preventing the deposition of dye onto fabric. Preferable dispersants include one or more of the following types:

i) an aryl sulfonic acid condensate, and ii) a poly(carboxylic acid) dispersant.

Finally, a third class of dye deposition inhibiting agents are acrylamide containing polymers. Acrylamide containing polymers useful in the present invention may be either thickeners or dispersants.

THICKENERS

The following are thickeners which are useful as dye deposition inhibiting agents.

Polyethoxylated Urethanes

Polyethoxylated urethanes, which are known for use as associative thickeners in latex compositions, are condensation polymers of polyether polyols and isocyanates. U.S. Pat. Nos. 4,079,028 and 4,155,892, incorporated herein by reference, describe in detail these polyurethane thickeners, which we have found useful as dye deposition inhibiting agents.

The polyethoxylated urethane is prepared in a nonaqueous media and is the reaction product of at least reactants (a) and (c), but the polymer optionally may include reactants (b) and (d) shown below:

(a) at least one water-soluble polyether alcohol containing one or more hydroxyl groups;

(b) at least one water-insoluble organic polyisocyanate;

(c) at least one monofunctional hydrophobic organic compound selected from a monofunctional active hydrogen compound and an organic monoisocyanate; and (d) at least one polyhydric alcohol or polyhydric alcohol ether.

The polyether alcohol containing one or more functional hydroxyl groups, reactant (a), is typically an adduct of an aliphatic, cycloaliphatic, or aromatic polyhydroxy compound such as an adduct of an alkylene oxide and a polyhydric alcohol or polyhydric alcohol ether, a hydroxyl-terminated prepolymer of such adduct and an organic polyisocyanate, or a mixture of such adducts with such prepolymers. Optionally, the polyether alcohol may contain just one hydroxyl group such as an alkyl polyethylene glycol, an alkylaryl polyethylene glycol, or a polycyclic alkyl polyethylene glycol where the alkyl group contains 1 to 20 carbon atoms.

A convenient source of the hydrophilic polyether polyol adducts is a polyalkylene glycol (also known as a polyoxyalkylene diol) such as polyethylene glycol, polypropylene glycol, or polybutylene glycol, of about 200 to about 20,000 molecular weight. However, adducts of an alkylene oxide and a monofunctional reactant such as a fatty alcohol, a phenol or an amine, or adducts of an alkylene oxide and a difunctional reactant such as an alkanolamine (e.g., ethanolamine) are also useful. Such adducts are also known as diol ethers and alkanolamine ethers.

Suitable compounds providing polyether segments also include amino-terminated polyoxyethylenes of the formula $NH_2(CH_2CH_2O)_xH$ where x ranges from about 10 to 200.

Reactant (c), a monofunctional hydrophobic organic compound, reacts with one or both terminal functional groups of the reaction product of reactants (a) and (b). A monofunctional hydrophobic organic compound include both a monofunctional active hydrogen compound and an organic monoisocyanate.

In the present invention, the term "monofunctional active hydrogen compound" means an organic compound having only one group which is reactive with isocyanate, such group containing an active hydrogen atom, where any other functional groups, if present, being substantially unreactive to isocyanate. Such compounds include monohydroxy compounds such as alcohols, alcohol ethers; and monoamines; as well as polyfunctional compounds providing the compound is only monofunctional to isocyanates. Representative of monofunctional active hydrogen compounds may include for example, the fatty ($C_1$ to $C_{24}$) alcohols such as methanol, ethanol, octanol, decanol, dodecanol, tetradecanol, hexadecanol, and cyclohexanol; phenolics such as phenol, cresol, octylphenol, nonyl and dodecyl phenol; alcohols ethers such as the monomethyl, monoethyl and monobutyl ethers of ethylene glycol, and the analogous ethers of diethylene glycol; alkyl and alkaryl polyether alcohols such as straight or branched ($C_1$ to $C_{22}$) alkanol/ethylene oxide and alkyl phenol/ethylene oxide adducts.

Amino compounds may be used in place of all or a portion of the monohydroxy compounds as hydrophobic monofunctional active hydrogen compounds. Amino compounds include primary or secondary aliphatic, cycloaliphatic, or aromatic amines such as the straight or branched chain alkyl amines, or mixtures thereof, containing about 1 to about 20 carbon atoms in the alkyl group. Suitable amines include n- and t-octyl amine, n-dodecyl amines, $C_{12}$ to $C_{14}$ or $C_{18}$ to $C_{20}$ t-alkyl amine mixtures, and secondary amines such as N,N-dibenzyl amine. N,N-dicyclohexyl amine and N,N-diphenyl amine. The amino compounds may contain more than one active hydrogen atom provided that under normal reaction conditions it is only monofunctional towards an isocyanate group. A primary amine is an example of such a compound.

In addition to a monofunctional active hydrogen compound, reactant (c) may be a monoisocyanate. The monoisocyanate may include $C_6$ to $C_{18}$ straight chain, branched chain, and cyclic isocyanates such as for example, butyl isocyanate, octyl isocyanate, dodecyl isocyanate, octadecyl isocyanate, and cyclohexyl isocyanate. These isocyanates may be used singly or in mixtures of two or more thereof.

The organic polyisocyanate, reactant (b), include di- and triisocyanates, isocyanate-terminated adducts of such polyhydric alcohols and organic di- or triisocyanates, as well as isocyanate-terminated prepolymers of polyalkylene ether glycols and organic di- or triisocyanates. While it is preferred that reactant (b) be an organic polyisocyanate, reactants containing one or more functional groups other than isocyanate are also suitable. The following are examples of monomers which can be used as reactant (b). These monomers may be used singly or in combination with one or more other reactant (b) monomers:

1,6-hexamethylene diisocyanate ("HDI")
2,6- and 2,4-tolylene diisocyanate ("TDI")
4,4'-methylene diphenylisocyanate ("MDI")
aliphatic triisocyanate product of the hydrolytic trimerization of 1,6-hexamethylene diisocyanate, sold under the brand name "Desmodur N"

The polyisocyanates also include any polyfunctional isocyanate derived from reaction of any of the foregoing isocyanates and an active hydrogen compound having a functionality of at least two, such that at least one isocyanate group remains unreacted. Such isocyanates are equivalent to chain-extending an isocyanate terminated isocyanate/diol reaction product with a reactant containing at least two active hydrogen atoms in a manner well known in polyurethane synthesis.

The isocyanates may contain any number of carbon atoms effective to provide the required degree of hydrophobic character. Generally, about 4 to 30 carbon atoms are sufficient, the selection depending on the proportion of the other hydrophobic groups and hydrophilic polyether in the product.

Reactant (d), a polyhydric alcohol or polyhydric alcohol ether, may be used to terminate isocyanate functionality or to link isocyanate-terminated reaction intermediates. The polyhydric alcohol or polyhydric alcohol ether may be aliphatic, cycloaliphatic or aromatic and may be used singly or in mixtures of either type or mixtures of the two types.

By appropriate selection of reactants and reaction conditions, including proportions and molecular weights of reactants, a variety of polymeric products may be obtained that may be linear or complex in structure. In summary, the reaction products formed include the following:

(1) a reaction product of at least one water soluble polyether alcohol containing at least one functional hydroxyl group reactant (a), a water insoluble organic polyisocyanate reactant (b) , and an organic monoisocyanate reactant (c);
(2) a reaction product of the reactant (a), wherein the water soluble polyether alcohol contains at least one functional hydroxyl group, and the organic monoisocyanate reactant (c);
(3) a reaction product of the reactant (a), the reactant (b), the organic monoisocyanate reactant (c) , and a reactant (d) selected from at least one polyhydric alcohol and polyhydric alcohol ether;
(4) a reaction product of the reactant (a), the water insoluble organic polyisocyanate reactant (b) containing two isocyanate groups, and an monofunctional active hydrogen containing compound; and
(5) a reaction product of the reactant (a), the water insoluble organic polyisocyanate reactant (b) containing at least three isocyanate groups, and the monofunctional active hydrogen containing compound.

Polyethoxylated urethanes useful as dye deposition inhibiting agents, generally will inhibit the deposition of dye during fabric finishing processes if:

(1) the polyether segment has a molecular weight of at least 200;

(2) the polyethoxylated urethane contains at least one hydrophobic group and at least one water soluble polyether segment;

(3) the sum of the carbon atoms in the hydrophobic groups are at least 4; and (4) the total molecular weight is at least 300 to about 60,000.

The polymers are prepared according to techniques generally known for the synthesis of urethanes preferably such that no isocyanate remains unreacted. Water should be excluded from the reaction since it will consume isocyanate functionality.

If desired, the reaction may be run in a solvent medium in order to reduce viscosity in those reactions leading to higher molecular weight products. Generally, a solvent is useful when molecular weights of 30,000 or higher are encountered. The solvent should be inert to isocyanate and capable of dissolving the polyoxyalkylene reactant and the urethane product at reaction temperature.

Order of addition, reactant proportions and other conditions of reaction such as the selection of the catalyst may be varied to control the geometry, molecular weight and other characteristics of the products, in accordance with well-known principles of polyurethane synthesis.

Acrylic Carboxylate Emulsion Polymers

Acrylic carboxylate emulsion polymers, useful in preventing the deposition of dye, are traditionally known for use in a wide variety of thickening applications, including latex coatings, drilling muds, and cosmetics. The acrylic carboxylate emulsion polymers are non-water-soluble, but become soluble in water and thicken when the pH is adjusted from about 6 to about 11. In this invention, the acrylic carboxylate emulsion polymers are either associative thickeners (containing hydrophobic groups) or non-associative thickeners (containing no hydrophobic groups). The acrylic carboxylate emulsion polymers which are associative thickeners are formed from (1) at least one monoethylenically unsaturated carboxylic acid, (2) at least one (meth)acrylic acid ester of an ethoxylated hydrocarbyl alcohol, and (3), at least one $C_1$ to $C_4$ alkyl acrylate or alkyl methacrylate, and optionally (4) one or more polyethylenically unsaturated monomer or a chain transfer agent. The acrylic carboxylate emulsion polymers which are non-associative thickeners are formed from (1) at least one monoethylenically unsaturated carboxylic acid, (3) at least one $C_1$ to $C_4$ alkyl acrylate or alkyl methacrylate, and optionally (4) one or more polyethylenically unsaturated monomer or a chain transfer agent. Specifically, monomers (1), (2), (3), and (4) for forming the acrylic carboxylate emulsion polymers are described as follows:

(1) A monoethylenically unsaturated carboxylic acid selected from (meth)acrylic acid, itaconic acid, and aryloxypropionic acid. Acrylic acid or methacrylic acid are preferred. The carboxylic acid portion of the copolymer may be present in the acid form, or neutralized with any common base alkali metal, or alkaline earth metal, ammonia, low molecular weight amine, or low quaternary salt hydroxide to form a water-soluble salt. By "(meth)acrylic" in this specification, we mean acrylic or methacrylic, (2) A (meth)acrylic acid ester of an ethoxylated $C_8$ to $C_{30}$ alkyl, alkylaryl or polycyclic hydrocarbyl alcohol having at least two oxyethylene units, preferably having 10 to 40 oxyethylene units, and having as many as 70 or so oxyethylene units. This ester being defined by the following general formula:

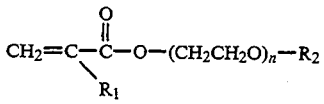

wherein $R_1$ is H or $CH_3$, the latter being preferred, n is at least 2, and preferably has an average value of at least 10, up to about 40 to about 60, or even up to about 70, and $R_2$ is a hydrophobic group for example an alkyl, alkylaryl, or polycyclic alkyl group where each alkyl group contains from about 8 to about 30 carbon atoms, preferably from about 16 to about 18 carbon atoms, (3) $C_1$ to $C_4$ alkyl acrylate or alkyl methacrylate, preferably ethyl acrylate, butyl acrylate, or methyl methacrylate, and (4) Optionally, a small amount of polyethylenically unsaturated monomer or a chain transfer agent.

A polyethylenically unsaturated monomer, monomer (4), serves to provide molecular weights in the higher range by light cross linking. Typical monomers used for light cross linking include diallylphthalate, divinylbenzene, allylmethacrylate, and ethylene glycol dimethacrylate. Alternatively, if lower molecular weights are desired, chain transfer agents can be used during the polymerization. Typical monomers used as chain transfer agents include carbon tetrachloride, bromoform, bromotrichloromethane, hydroxyethyl mercaptan, β-mercaptopropionic acid, and long chain alkyl mercaptans and thioesters such as n-dodecyl mercaptan, t-dodecyl mercaptan, octyl mercaptan, tetradecyl mercaptan, hexadecyl mercaptan, butyl thioglycolate, isooctyl thioglycolate, and dodecyl thioglycolate.

Associative Acrylic Carboxylates

An acrylic carboxylate emulsion of the associative thickener type should have a molecular weight ranging from about 50,000 to about 1,500,000. Preferably, the molecular weight is from about 50,000 to about 600,000.

For the (meth)acrylic acid ester of an ethoxylated hydrocarbyl alcohol (monomer (2)), $R_2$ may typically be an alkyl ($C_8$ to $C_{24}$), an alkylaryl, or the residue of a polycyclic hydrocarbyl compound such as lanolin or cholesterol. Alkyl groups include octyl ($C_8$), lauryl ($C_{12}$), tridecyl ($C_{13}$), myristyl ($C_{14}$), pentadecyl ($C_{15}$), cetyl ($C_{16}$), palmityl ($C_{17}$), stearyl ($C_{18}$), and eicosyl ($C_{19}$). Mixtures may also be used, such as alkyl groups resulting from the ethoxylation of a mixture of lauryl, stearyl, cetyl, and palmityl alcohols. Alkylaryl groups include alkylphenyl groups such as octylphenyl and nonylphenyl. Methods suitable for preparing monomer component (2) are known in the art and are summarized in U.S. Pat. No. 4,384,096.

Monomer components for associative acrylic carboxylate emulsion polymers are used, in the ranges of (1) from about 20 to about 60 weight percent of the monoethylenically unsaturated carboxylic acid, (2) from about 0.5 to about 25 weight percent of the (meth)acrylic acid ester of an ethoxylated hydrocarbyl alcohol, and (3) at least 30 weight percent of the $C_1$ to $C_4$ alkyl acrylate or alkyl methacrylate. Optionally, a chain transfer agent, may be used at a level from about 0.1 to 5 weight percent to obtain a low molecular weight. If a high molecular weight polymer is desired, a polyethylenically unsaturated copolymerizable monomer at a level from about 0.05 to 1 wt percent can be used for crosslinking.

Nonassociative Acrylic Carboxylates

Nonassociative acrylic carboxylate thickeners have molecular weights ranging from about 100,000 to 1,500,000. Preferably, the molecular weight is from about 100,000 to about 1,000,000.

Monomer components for forming nonassociative acrylic carboxylate emulsion polymers are used, in the ranges of (1) from about 20 to about 75 weight percent of the monoethylenically unsaturated carboxylic acid, and (3) from about 25 to about 80 weight percent of the $C_1$ to $C_4$ alkyl acrylate or alkyl methacrylate. Optionally, from about 0.1 to 5 weight percent chain transfer agent (monomer 4) may be used to obtain a low molecular weight polymer. If a high molecular weight polymer is desired, from about 0.05 to 1 wt % of a polyethylenically unsaturated copolymerizable monomer may be used for crosslinking.

The acrylic carboxylate emulsions are prepared by emulsion polymerization where typically the solids content is from about 25 to 50 percent by weight. Emulsion techniques for preparing the acrylic carboxylates useful in this invention are well known to those skilled in the art. For example, the monomers may be polymerized in an aqueous dispersion containing an anionic surfactant, such as sodium lauryl sulfate and a water soluble free radical initiator such as an alkali metal persulfate or ammonium persulfate. Additionally, a small amount of polyethylenically unsaturated monomer or a chain transfer agent may be added to raise or lower the molecular weight.

DISPERSANTS

The following are the dispersants which are useful in preventing the deposition of dye onto fabric.

Aryl Sulfonic Acid Condensates

Aryl sulfonic acid condensates, useful for preventing dye deposition are well known dispersants for aqueous systems. The compounds are typically formed through the condensation of at least one aldehyde, preferably formaldehyde, with one or more aromatic containing compounds, followed by sulfonation of the polymer. The aryl sulfonic acid condensate compounds may be linear or crosslinked in structure. The aryl sulfonic acid condensate compounds may vary in molecular weight from about 220 to about 2000. Preferably the molecular weight is from about 220 to about 1000.

The aromatic containing compound may be a single aromatic ring such as for example benzene, or a fused aromatic ring such as for example naphthalene, anthracene, or penanthrene. Additionally, the aromatic containing compound may be a lignan or lignin. The aromatic containing compound may be substituted with one or more functional groups, such as for example, with a $C_1$ to $C_6$ straight or branched alkyl group, a hydroxyl group, or a halogen group.

The aromatic nucleus contains one or more sulfonic acid groups. Optionally, the sulfonic acid group on the aromatic nucleus may be neutralized to form a salt with any common base alkali metal, or base alkaline earth metal, ammonia, low molecular weight amine, or low molecular weight quaternary salt hydroxides.

The preferred aromatic nucleus is an unsubstituted naphthalene ring containing one or more sulfonic acid groups.

The process for making these aryl sulfonic acid condensate compounds is well known to those skilled in the art. Typically, the aromatic containing compound or a mixture of different aromatic containing compounds are reacted with an aldehyde, preferably formaldehyde in the presence of an alkali or acid to form the aryl condensate compound and water. The aryl condensate compound is subsequently sulfonated with sulfuric acid, and optionally may be neutralized to form the corresponding salt of the aryl sulfonic acid condensate.

The aryl sulfonic acid condensate compounds are sold by various suppliers under various tradenames. A list of some of the tradenames these compounds are sold under is shown below, but is not intended to be a complete list: Aerosol NS surfactant (American Cyanamid Co.); Blancol® Liquid, Blancol N Powder (Rhone-Poulenc); Darvan No. 1, Darvan No. 9 (R. T. Vanderbilt Co. Inc.); Daxad® 11, Daxad® 17 (W. R. Grace & Co.); Harol D, Harol RG-71 (Graden Chemicals); Lomar DL (Henkel Corp.); Morwet D-425 (Witco Corp.); Petro® Dispersant 425 (Witco Corp.); Tamol® SN or Tamol® L Concentrate (Rohm and Haas Co.); Vikosperse KDS (Vikon Chemical Co., Inc.).

Poly(Carboxylic Acid) Dispersants

Poly(carboxylic acid) dispersants useful in preventing the deposition of dye are commonly used as dispersants in aqueous systems, and are of two types: 1) acrylic carboxylates, and 2) poly(amino acids) containing carboxylic acid groups.

Acrylic carboxylates are formed from (1) at least one monoethylenically unsaturated carboxylic acid monomer selected from methacrylic acid, acrylic acid, itaconic acid, and aryloxypropionic acid, and (2) at least one $C_1$ to $C_4$ alkyl acrylate or alkyl methacrylate monomer. The preferred monoethylenically unsaturated carboxylic acid monomer (1) is acrylic acid and methacrylic acid, and the preferred $C_1$ to $C_4$ alkyl acrylate or alkyl methacrylate monomer (2) is ethyl acrylate, butyl acrylate, or methyl methacrylate. The monoethylenically unsaturated carboxylic acid monomer (1) may be present in the acid form, or in the form of a water-soluble salt. Such salts include alkali metal salts, ammonium salts, or amine salts.

The acrylic carboxylate dispersants contain from about 70 to about 98 weight percent of the monoethylenically unsaturated carboxylic acid monomer (1), and from about 2 to about 30 weight percent of the $C_1$ to $C_4$ alkyl acrylate or alkyl methacrylate monomer (2). Preferably, the acrylic carboxylates contain from about 80 to 95 weight percent of the monoethylenically unsaturated carboxylic acid monomer (1), and from about 5 to 20 weight percent of the $C_1$ to $C_4$ alkyl acrylate or alkyl methacrylate monomer (2).

The acrylic carboxylate dispersants useful in the present invention have molecular weights ranging from about 1,000 to 30,000, preferably have a molecular weight from about 1500 to 10,000, and most preferably have a molecular weight from about 2,000 to about 7,000 as measured by aqueous gel permeation chromatography relative to a polyacrylic acid standard having a molecular weight of 4500.

Methods of making acrylic carboxylates are well known to persons skilled in the art of copolymerization. The process used to prepare the copolymers may be aqueous based or solvent based, it may be run as a batch process, a semi-continuous process or continuous process. The reaction may be thermally initiated, redox initiated or free-radical initiated. The copolymers may be isolated from solution by any of the conventional means or it may be used as a dilute solution. Preferably, the process used for the production of the copolymers is an aqueous based, free-radical initiated process and the copolymer is used as a dilute aqueous solution.

In addition to acrylic carboxylates, poly(amino acids) containing carboxylic acid groups are useful for preventing dye deposition. Poly(amino acids) useful in the present invention have molecular weights from about 1000 to about 100,000.

Poly(amino acids) useful in the present invention may include for example poly(aspartic acid), polysuccinimide and copolymers of poly(amino acids). These compounds can be prepared by techniques well known to those skilled in the art.

ACRYLAMIDE CONTAINING POLYMERS

Water soluble or water dispersible acrylamide polymers, useful for preventing dye deposition, are known for use as thickeners, rheology modifiers, and dispersants.

Generally, the acrylamide containing polymers are prepared by a free radical initiated polymerization process in the presence of a chain transfer agent. The acrylamide containing polymers are formed from (1) at least one acrylamide or N-substituted acrylamide monomer, and optionally (2) one or more vinyl monomers described as follows:

(1) An acrylamide or N-substituted acrylamide having the following structural formula:

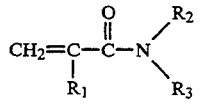

wherein, $R_1$ can be H or a $C_1$ to $C_4$ alkyl group, H or $CH_3$ being preferred, $R_2$ and $R_3$ are either independently selected from the group consisting of hydrogen, methyl, ethyl, propyl, isopropyl, butyl, t-butyl, and isobutyl; or $R_2$ and $R_3$ together with the nitrogen, to which they are attached, to form three to seven membered nonaromatic nitrogen heterocycle.

(2) A vinyl monomer such as a $C_1$ to $C_6$ alkyl (meth)acrylate, hydroxyalkyl (meth)acrylate, hydroxyaryl (meth)acrylate, alkoxyalkyl (meth)acrylate, polyalkoxyalkyl (meth)acrylate, styrene, vinyltoluene, alkyl vinyl ethers, such as butyl vinyl ether, amino monomers such as amino-substituted alkyl (meth)acrylates, amino-alkyl vinyl ethers, and maleic anhydride. Also, vinyl monomers substituted with carboxylic acid may be used, such as for example, maleic acid, fumaric acid, itaconic acid, (meth)acrylic acid or the salts thereof.

By "(meth)acrylic", we mean acrylic or methacrylic acid or ester. Salts of the carboxylic acid substituted vinyl monomer may be formed by partially or completely neutralizing the carboxylic acid substituted vinyl monomers with one or more common base alkali metal or alkaline earth metal, ammonia, low molecular weight amine, or low quaternary salt hydroxides.

The preparation of acrylamide polymers useful in this invention can be prepared by any number of techniques, well known to those skilled in the art. The preferred method is a radical initiated solution polymerization in water or a water and cosolvent mixtures. The cosolvent may be, for example, tert-butanol, monobutyl ether of ethylene glycol, or diethylene glycol. A less preferred method is precipitation polymerization in a polar organic solvent such as methanol, ethanol, n-propanol, isopropanol, n-butanol, sec-butanol, isobutanol, tert-butanol, ethylene glycol monoalkyl ether, diethylene glycol ethers, acetone, methyl ethyl ketone, ethyl acetate, acetonitrile, dimethylsulfoxide, or tetrahydrofuran, as well as mixtures of these solvents with or without water. Some of the aforesaid solvents function as efficient chain transfer agents and will lower the molecular weight of the product polymer.

Chain transfer agents may be added in an amount of from about 0.5 to about 12 percent by weight, based on the total weight of reactants added, to the polymerization process to lower the molecular weight of the polymer, or to add hydrophobic groups to the polymer to produce an associative thickener. Chain transfer agents useful for lowering the molecular weight may include for example mercaptans, such as ethyl mercaptan, n-propyl mercaptan, n-amyl mercaptan, hydroxy ethyl mercaptan, mercaptopropionic acid, and mercaptoacetic acid; halogen compounds such as carbon tetrachloride, tetrachloroethylene; some primary alkanols such as benzyl alcohol, ethylene glycol, and diethylene glycol; some secondary alcohols such as isopropanol; and bisulfite such as sodium bisulfite. Chain transfer agents useful in producing an associative thickener are water insoluble, and are preferably a long chain alkyl mercaptan, such as n-dodecyl mercaptan, t-dodecyl mercaptan, octyl mercaptan, tetradecyl mercaptan, and hexadecyl mercaptan. The amount of chain transfer agent added to the polymerization process depends on the efficiency of the chain transfer agent. For example, if a less efficient chain transfer agent is used, such as sodium bisulfite, from about 5 to about 12 percent by weight of chain transfer agent may have to be used, where as if an efficient chain transfer agent is used, such as a mercaptan, only from about 0.5 to about 5 weight percent chain transfer agent may have to be used.

The molecular weight range of these polymers are from about 2,000 to about 500,000. Preferably, the molecular weight is from about 20,000 to 60,000. The acrylamide containing polymer is useful as a dye deposition inhibiting agent when the acrylamide containing polymer is formed from about 50 to 100 weight percent of the acrylamide or N-substituted acrylamide monomer (1), and 0 to about 50 weight percent of the vinyl monomer (2). Acrylamide containing polymers particularly useful in preventing .dye deposition are polymers formed where the acrylamide or N-substituted acrylamide monomer is dimethylacrylamide, methylacrylamide, and acrylamide, or mixtures thereof, and the vinyl monomer is nonionic, such as for example the hydroxyalkyl (meth)acrylate or alkyl (meth)acrylate.

The dye deposition inhibiting agents in this invention are effective in preventing the deposition of indigo blue.

However, more generally, the dye deposition inhibiting agents are effective in preventing the deposition of dyes when the dyes are nonionic. Furthermore, the dye deposition inhibiting agents which are nonionic when dissolved in an aqueous solution, such as for example, the polyethoxylated urethanes and some of the polyacrylamide containing polymers prevent the deposition of dyes when such dyes are anionic, cationic, or amphoteric when dissolved in an aqueous solution. However, the dye deposition inhibiting agents which are anionic, such as for example, the polycarboxylic dispersants, the aryl sulfonic acid condensates, and the acrylic carboxylate emulsions, are most effective for inhibiting the deposition of nonionic and cationic dyes, and may not be effective in inhibiting the deposition of anionic dyes.

PERFORMANCE EVALUATION OF DYE DEPOSITION INHIBITING AGENTS

Generally, the dye deposition inhibiting agents were tested at typical wash and rinse conditions for prewashing and stonewashing processes. For example, stonewashing tests were performed at an acidic pH of 5.4 to 5.6 because acidic pH conditions are typical for a stonewash process. Prewashing tests were performed at a pH of 11.8 because basic pH conditions are typical for a prewash process.

Test Conditions

The equipment used for Examples 1 to 16 was a 1.6 gallon (6 liter) Eumenia model EU-340 front loading washer/extractor. To test the efficacy of the dye deposition inhibiting agents the following ingredients were added to the washer in the order listed: 1) ballast (cotton towels), 2) tap water, 3) dye deposition inhibiting agent, 4) surfactant, and 5) dye. The above five ingredients may be added in any order. After these ingredients were added, the pH was adjusted to between 5.4 and 5.6 with acetic acid to simulate the acidic wash conditions in stonewashing, or was adjusted to a pH of around 11 to 12 with NaOH to simulate prewashing conditions. Following the pH adjustment, test fabrics were added to the washer. The washing machine load was about 10 parts by weight water to about 1 part by weight test fabric and ballast.

A 30 minute wash cycle was then run followed by 5 separate rinses, each rinse cycle taking about 90 seconds to complete. Following the washing and rinse cycles, the test fabrics were removed from the washer and air dried.

In this test method, the dye was added to the bath before adding the test fabric to simulate the release of dye. In each test, enough dye was added to the bath to produce a concentration of dye that would dye the test fabrics blue. This test method is actually more severe since all the dye in this test method is "released" simultaneously. In real stonewashing and prewashing processes, the dye is gradually released, such that the dye deposition inhibiting agent does not have to inhibit a large concentration of dye immediately after the fabric is added to the bath.

Fabrics Tested

The fabrics tested were bleached cotton, duck cloth, cotton 405, and cotton broad cloth. These fabrics were obtained from Test Fabrics in Middlesex, N.J. and were cut into approximately 5 inch by 5 inch squares. To remove nonpermanent fabric finishes, the test fabrics were washed in hot (120° F. or 68° C.) water with ordinary laundry detergent before testing. For each test, at least 5 test fabrics of the same type were washed at the same time to produce an average reflectance value.

Dyes Tested

Indigo blue dye for these tests was obtained from Pylam Products company located in Garden City, N.Y. The concentration of the indigo blue dye in the bath (excluding the weight of the fabric and ballast) ranged from about 1000 to about 1300 ppm.

Performance Properties Tested

The color intensity of the test fabric was determined by measuring Y reflectance units using a colorimeter (Colorguard ® System /05, manufactured by Gardner). Higher Y reflectance values correspond to a whiter fabric which is desirable because less dye has deposited onto the fabric. These reflectance values were compared to the reflectance values of test fabrics washed at the same test conditions, but with no dye deposition inhibiting agent. The ΔY value shown in TABLES 2, 3, 5, 6, and 7 is the difference in the reflectance of the test fabric washed with dye deposition inhibiting agent minus the reflectance value of the test fabric washed without dye deposition inhibiting agent. Therefore, the ΔY value shows the improvement in reflectance obtained by using dye deposition inhibiting agents. A ΔY value of at least 2 indicates that the dye deposition inhibiting agent is preventing the deposition of dye onto the fabric in the bath, preferred dye deposition inhibiting agents in this invention have ΔY values of 7 or more in TABLES 2, 3, 5, 6, and 7.

The wash conditions for Examples 1 to 16 are summarized below in Table 1.

TABLE 1

| WASH CONDITIONS FOR EXAMPLES 1 to 16 | |
|---|---|
| Washing Cycle Water Temperature | 65° C. |
| Water Hardness | 200 ppm |
| Agitation | High |
| Wash Cycle Time | 30 minutes |

Example 1 to 3

Effectiveness of Acrylic Carboxylate Emulsions

Examples 1 to 3 were tested according to the procedures described in the subsection "Test Conditions". Examples 1 and 2 were tested at an acidic pH and Example 3 was tested at a basic pH as indicated in Table 2. In Examples 1 to 3,200 ppm of nonylphenolethoxylate was used as the surfactant in the wash solution. Table 2 shows the efficacy of the acrylic carboxylate emulsion polymers as dye deposition inhibiting agents. Both the associative (Example 2) and nonassociative (Example 1 and 3) thickeners are effective in inhibiting the deposition of dye at a pH of 5.4 to 5.6 which is representative of wash conditions for stonewashing. Example 3 shows that acrylic carboxylate emulsions are effective also at a pH of 11.8, which is representative of prewashing conditions.

TABLE 2

Efficacy of Acrylic Carboxylate Emulsions

| Acrylic Carboxylates | Monomer Composition | Molecular Weight | Dye Deposition Inhibiting Agent Conc. (ppm) | pH | Net Change in Reflectance (Δ Y) Cotton Duck | Cotton 405 |
|---|---|---|---|---|---|---|
| Example 1 | 65 AA/35 EA | 500,000 | 200 | 5.4 to 5.6 | 11.6 | 8.3 |
| Example 2 | 40 MAA/50 EA/10 EOMA | 500,000 | 200 | 5.4 to 5.6 | 12.8 | 8.3 |
| Example 3 | 65 AA/35 EA | 500,000 | 250 | 11.8 | 11.0 | — |

KEY for TABLE 2
AA Percent by weight acrylic acid
EA Percent by weight ethyl acrylate
MAA Percent by weight methacrylic acid
EOMA Percent by weight of a methacrylic acid ester of a $C_{16}$ to $C_{18}$ alkyl monoether of a polyethylene glycol having 20 oxyethylene units.

Example 4 to 6

Effectiveness of Poly(Carboxylic Acid) Dispersants

Examples 4 to 6 and Comparative A were tested according to the procedures described in the subsection "Test Conditions". Examples 4 and 5 were tested at an acidic pH and Example 6 was tested at a basic pH as indicated in Table 3. In all Examples in Table 3 (Examples 4 to 6 and Comparative A) 200 ppm of nonylphenolethoxylate was used as the surfactant in the wash solution. Table 3 shows that the poly(carboxylic acid) dispersants which are formed from acrylic acid and ethyl acrylate are effective as dye transfer inhibiting agents. However, Comparative 1 demonstrates that a homopolymer of poly(acrylic acid) at a molecular weight of 4500 and an acidic pH is not as effective as a dye deposition inhibiting agent. The poly(carboxylic acid) dispersants are effective as dye transfer inhibiting agents at typical stonewashing conditions (Examples 4 and 5) and typical prewashing conditions (Example 6).

TABLE 5 were tested at a pH of 5.4 to 5.6 (stonewashing conditions). Additionally, in all examples in TABLE 5, except Example 9,200 ppm of nonylphenolethoxylate was used as the surfactant in the bath. In Example 9, no surfactant was added to the bath for the test. TABLES 4 and 5 show that both linear and complex polyethoxylated urethanes are effective in preventing dye deposition. Example 9 demonstrates that the dye deposition inhibiting agents are also effective when no surfactant is added to the bath.

TABLE 4

Structures of Polyethoxylated Urethanes

| Polyethoxylated Urethane | Structure/ Formula | Reactant (a) | Reactant (b) | Reactant (c) |
|---|---|---|---|---|
| Example 7, 8, and 9 | Linear | PEG 8000 | HMDI | n-hexanol |
| Example 10 | Complex | PER | TDI | Me PEG |

KEY for TABLE 4:
HMDI 4,4'-biscyclohexylmethane diisocyanate.
Me PEG Polyethylene glycol monomethyl ether with a molecular weight = 550
OI octylisocyanate
PEG 8000 Polyethylene glycol monoether with a molecular weight = 8000.
PER Pentaerythritol

TABLE 3

Efficacy of Poly(Carboxylic Acid) Dispersants

| Poly(Carboxylic Acid) | Monomer Composition | Molecular Weight | Dye Deposition Inhibiting Agent Conc. (ppm) | pH | Net Change in Reflectance (Δ Y) Cotton Duck | Cotton 405 |
|---|---|---|---|---|---|---|
| Comparative 1 | 100 AA | 4500 | 500 | 5.4 to 5.6 | — | −1.3 |
| Example 4 | 95 AA/5 EA | 2300 | 500 | 5.4 to 5.6 | — | 3.1 |
| Example 5 | 95 AA/5 EA | 2300 | 1000 | 5.4 to 5.6 | — | 3.8 |
| Example 6 | 95 AA/5 EA | 2300 | 250 | 11.8 | 4.0 | 8.0 |

KEY for TABLE 3:
AA Percent by weight acrylic acid
EA Percent by weight ethyl acrylate

Examples 7 to 10

Efficacy of Polyethoxylated Urethanes

Examples 7 to 10 were tested according to the procedures described in the subsection "Test Conditions". The reactants that the polyethoxylated urethanes are formed from and the structures of the polyethoxylated urethanes are shown in TABLE 4. All examples in TDI Toluene 2,4 diisocyanate

TABLE 5

Efficacy of Polyethoxylated Urethanes

| Polyethoxylate d Urethane | Molecular Weight | Dye Deposition Inhibiting Agent Conc. (ppm) | pH | Surfactant Used | Net Change in Reflectance (Δ Y) Cotton Duck | Cotton 405 |
|---|---|---|---|---|---|---|
| Example 7 | 30,000 | 250 | 5.4 to 5.6 | 200 ppm NPE | 7.5 | — |
| Example 8 | 30,000 | 500 | 5.4 to 5.6 | 200 ppm NPE | 11.0 | 14.0 |
| Example 9 | 30,000 | 500 | 5.4 to 5.6 | None | 12.0 | 8.0 |
| Example 10 | 3,000 | 500 | 5.4 to 5.6 | 200 ppm NPE | 31.2 | 13.9 |

KEY for TABLE 5:
NPE Nonylphenolethoxylate

Examples 11 to 14

Efficacy of Aryl Sulfonic Acid Condensates

Examples 11 to 14 in TABLE 6 Were tested according to the procedures described in the subsection "Test Conditions". Examples 11 to 14 are all naphthalene sulfonic acid condensates formed from the reaction of naphthalene with formaldehyde, followed by sulfonation with sulfuric acid. In TABLE 6, Examples 11 to 13 were tested at a pH of 5.4 to 5.6 (stonewashing conditions). Additionally, for all examples in TABLE 6, except for Example 12, 200 ppm of nonylphenolethoxylate was used as the surfactant in the bath. In Example 12, no surfactant was used in the test. Examples 11 to 14 show that aryl sulfonic acid condensates are effective as dye deposition inhibiting agents. Examples 11 and 13 show that by increasing the level of dye deposition inhibiting agent in the bath from 250 ppm to 500 ppm the ΔY reflectance value improves. Example 12 demonstrates that aryl sulfonic acid condensates prevent the deposition of dye when no surfactant is present in the wash bath.

Series 80 Model 110 washing machine. To test the efficacy of the poly(amino) acids as dye deposition inhibiting agents, the following ingredients were added to the washer in the order listed: 1) ballast (cotton towels), 2) tap water at 200 ppm hardness and 100° F., 3) 32 grams of Ultra Tide ®, 4) poly(aspartic acid) with a molecular weight of 2000, and 5) direct red no. 81 dye. Following the addition of the direct red dye, test fabrics were added to the washer. The washing machine load was about 20 parts by weight water to about 1 part by weight test fabric and ballast.

A 20 minute wash cycle was then run, followed by 2 separate rinse and spin cycles, each rinse and spin cycle taking about 7 minutes to complete. Following the wash, rinse and spin cycles, the test fabrics were removed from the washer and air dried.

The fabrics tested were duck cloth and cotton 405. As in the previous examples, these fabrics were obtained from Test Fabrics, were cut into approximately 5 inch by 5 inch squares, and were prewashed to remove nonpermanent finishes. For each test, at least 5 test fabrics of the same type were washed at the same time to produce an average reflectance value.

TABLE 6

Efficacy of Aryl Sulfonic Acid Condensates

| Aryl Sulfonic Acid Condensates | Molecular Weight | Dye Deposition Inhibiting Agent Conc. (ppm) | pH | Surfactant Used | Net Change in Reflectance (Δ Y) Cotton Duck | Cotton 405 | Broad Cloth |
|---|---|---|---|---|---|---|---|
| Example 11 | 500 | 250 | 5.4 to 5.6 | 200 ppm NPE | 6.9 | 2.2 | — |
| Example 12 | 500 | 500 | 5.4 to 5.6 | None | 3.0 | 7.0 | — |
| Example 13 | 500 | 500 | 5.4 to 5.6 | 200 ppm NPE | 8.0 | 18.0 | 17 |
| Example 14 | 500 | 250 | 11.8 | 200 ppm NPE | 7.0 | 1.0 | 10 |

Example 15

Efficacy of Acrylamide Polymers

Example 15 in TABLE 7 was tested according to the procedures described in the subsection "Test Conditions". Example 15 was tested at a pH of 5.4 to 5.6 (stonewashing conditions). Additionally, in Example 15, 200 ppm of nonylphenolethoxylate was used as the surfactant in the bath. Table 7, demonstrates that acrylamide polymers are effective in preventing the deposition of dye.

The direct red no. 81 dye was obtained from Aldrich Chemical Company Inc. located in Milwaukee, Wis. The concentration of the direct red dye in the bath (excluding the weight of the fabric and ballast) ranged from about 1000 to about 1300 ppm.

As in the previous examples, the amount of dye deposition was determined by measuring Y reflectance units using a colorimeter (Colorguard ® System /05, manufactured by Gardner).

Example 16 in Table 8 below shows that poly(aspartic acid) at a molecular weight of 2000 is effective as a dye deposition inhibiting agent. The pH of the bath during this test was around 11, representing prewash conditions.

TABLE 7

Efficacy of Acrylamide Polymers

| Acrylamide Polymers | Monomer Composition | Molecular Weight | Dye Deposition Inhibiting Agent Conc. (ppm) | pH | Net Change in Reflectance (Δ Y) Cotton Duck | Cotton 405 |
|---|---|---|---|---|---|---|
| Example 15 | 80 DMAC/20 HEMA | 32,000 | 250 | 5.4 to 5.6 | 2.1 | 11.4 |

KEY for TABLE 7:
DMAC Percent by weight N,N-dimethylacrylamide
HEMA Percent by weight hydroxyethyl methacrylate Example 16

Efficacy of Poly(amino acids)

The efficacy of poly(amino) acids were tested at different wash conditions from Examples 1 to 15. The equipment used was a 22 gallon Kenmore Fabric Care

TABLE 8

Efficacy of Poly(amino acids)

| Poly (amino acids) | Dye deposition inhibiting agent | Molecular Weight | Dye Deposition Inhibiting Agent Conc. (ppm) | pH | Net Change in Reflectance (Δ Y) Cotton Duck | Cotton 405 |
|---|---|---|---|---|---|---|
| Example 16 | poly(aspartic acid) | 2,000 | 75 | 11 | 2.6 | 3.6 |

Examples 17 to 20

Fabric Finishing Compositions

The dye deposition inhibiting agents can be formulated into liquid or solid fabric finishing compositions for stonewashing and prewashing fabric finishing processes. Typical liquid and solid fabric finishing compositions are shown in Examples 17 and 18 for stonewashing, and in Examples 19 and 20 for prewashing.

TABLE 9

| Ingredient | Typical Fabric Finishing Compositions: Liquid Formulation Stonewashing Example 17 | Solid Formulation Stonewashing Example 18 | Liquid Formulation Prewashing Example 19 | Solid Formulation Prewashing Example 20 |
|---|---|---|---|---|
| Neodol ® 23 - 6.5 | 0 to 25 wt % | 0 to 25 wt % | 0 to 50 wt % | 0 to 50 wt % |
| pAA | 0 to 10 wt % | 0 to 10 wt % | 0 to 10 wt % | 0 to 10 wt % |
| NAOH/silicate | — | — | 0 to 50 wt % | 0 to 50 wt % |
| Sodium Sulfate | — | 10 to 75 wt % | — | 10 to 75 wt % |
| Cellulase Enzyme | 0.1 to 80 wt % | 10 to 80 wt % | — | — |
| Water | Balance | Balance | Balance | Balance |
| Acetic Acid | 0 to 50 wt % | 0 to 50 wt % | — | — |
| Dye Deposition Inhibiting Agent | 0.1 to 25 wt % | 0.1 to 25 wt % | 0.1 to 25 wt % | 0.1 to 25 wt % |

KEY for TABLE 9:
pAA poly(acrylic acid), molecular weight = 4500
Neodol 23 - 6.5 primary alcohol ethoxylate, Shell Chemical Company
NaOH/silicate Weight ratio of Na to Si is 3.2:1

We claim the following:

1. A fabric finishing composition consisting essentially of:

(A) from about 0.1 to about 45 weight percent of at least one dye deposition inhibiting agent selected from the group consisting of:

(1) a polyethoxylated urethane;

(2) an aryl sulfonic acid condensate comprising a sulfonated reaction product of a) at least one aldehyde, and b) at least one aromatic containing compound, and wherein the condensate contains an aromatic nucleus having at least one sulfonic acid group attached thereto;

(3) an acrylic carboxylate dispersant polymer comprising: a) from about 70 to about 98 weight percent of at least one monoethylenically unsaturated carboxylic acid monomer, and (b) from about 2 to about 30 weight percent of at least one alkyl (meth)acrylate monomer;

(4) an acrylamide containing polymer having a molecular weight from about 2,000 to about 500,000;

(5) a poly(amino acid); and (6) an acrylic carboxylate emulsion polymer comprising: a) from about 20 to about 75 weight percent of at least one monoethylenically unsaturated carboxylic acid, and b) from about 25 to about 80 weight percent of at least one alkyl (meth)acrylate; and (B) from 99.9 to 55 weight percent of at least one of each of the following: a builder; a surfactant different from the dye deposition inhibiting agent; a first additive selected from the group consisting of: a buffering agent, bleaching agent, anti-corrosion agent, cellulase enzyme, stabilizer, fabric softener, perfume, and opacifier; and a second additive selected from the group consisting of: water, solvent, inert diluent, and solid forming agent.

2. An aqueous treatment solution for inhibiting the deposition of dye on fabric being treated in a fabric finishing process, comprising: 1) water and 2) the fabric finishing composition of claim 1, wherein the concentration of the dye deposition inhibiting agent in the aqueous treatment solution is from 25 to 2000 ppm by weight.

3. The fabric finishing composition of claim 1, wherein the dye deposition inhibiting agent is the polyethoxylated urethane, and wherein the polyethoxylated urethane is selected from the group consisting of:

(1) a reaction product of at least one water soluble polyether alcohol containing at least one functional hydroxyl group reactant (a), a water insoluble organic polyisocyanate reactant (b), and an organic monoisocyanate reactant (c);

(2) a reaction product of the reactant (a), wherein the water soluble polyether alcohol contains at least one functional hydroxyl group, and the organic monoisocyanate reactant (c);

(3) a reaction product of the reactant (a), the reactant (b), the organic monoisocyanate reactant (c), and a reactant (d) selected from at least one polyhydric alcohol and polyhydric alcohol ether;

(4) a reaction product of the reactant (a), the water insoluble organic polyisocyanate reactant (b) containing two isocyanate groups, and an monofunctional active hydrogen containing compound; and (5) a reaction product of the reactant (a), the water insoluble organic polyisocyanate reactant (b) containing at least three isocyanate groups, and the monofunctional active hydrogen containing compound.

4. The fabric finishing composition of claim 3 wherein the polyethoxylated urethane reactant (a) is pentaerythritol, reactant (b) is toluene 2,4 diisocyanate, and reactant (c) is polyethylene glycol monomethyl ether.

5. The fabric finishing composition of claim 1, wherein the dye deposition inhibiting agent is the acrylic carboxylate emulsion polymer and wherein the acrylic carboxylate emulsion polymer comprises:

(1) about 20 to about 50 weight percent of at least one monoethylenically unsaturated carboxylic acid selected from (meth)acrylic acid, itaconic acid, and aryloxypropionic acid and salts thereof;

(2) about 0.5 to about 25 weight percent at least one (meth)acrylic acid ester of an ethoxylated alkyl, alkylaryl or polycyclic hydrocarbyl alcohol of the formula:

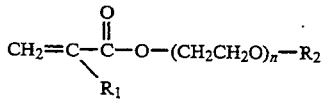

wherein, $R_1$ is H or $CH_3$, n is from about 2 to about 60, and $R_2$ is a hydrophobic group selected from the group consisting of an alkyl, alkylaryl, and polycyclic alkyl group, wherein each alkyl group contains from 8 to 30 carbon atoms; and (3) about 40 to about 60 weight percent of at least one $C_1$ to $C_4$ alkyl (meth)acrylate.

6. The fabric finishing composition of claim 1, wherein the dye deposition inhibiting agent is the acrylic carboxylate emulsion polymer, and wherein the acrylic carboxylate emulsion polymer comprises:

(1) about 20 to about 75 weight percent of at least one monoethylenically unsaturated carboxylic acid selected from (meth)acrylic acid, itaconic acid, and aryloxypropionic acid and salts thereof; and (2) about 25 to about 80 weight percent of at least one $C_1$ to $C_4$ alkyl (meth)acrylate.

7. The fabric finishing composition of claim 1 wherein the dye deposition inhibiting agent is the aryl sulfonic acid condensate, wherein the aryl sulfonic acid condensate comprises: a sulfonated reaction product of formaldehyde with at least one aromatic containing compound selected from the group consisting of: benzene, naphthalene, and anthracene, and wherein the condensate contains an aromatic nucleus of the aryl sulfonic acid condensate further comprises at least one sulfonic acid group attached thereto.

8. The fabric finishing composition of claim 1 wherein the dye deposition inhibiting agent is the acrylamide containing polymer and wherein the acrylamide containing polymer comprises:

(1) about 50 to 100 weight percent of at least one acrylamide or N-substituted acrylamide having the structural formula:

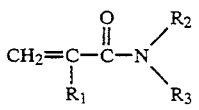

wherein, $R_1$ is H or a $C_1$ to $C_4$ alkyl group, $R_2$ and $R_3$ are either independently selected from the group consisting of hydrogen, methyl, ethyl, propyl, isopropyl, butyl, t-butyl, and isobutyl;

or where $R_2$ and $R_3$ together with the nitrogen, to which they are attached, to form three to seven membered nonaromatic nitrogen heterocycle; and (2) from about 0 to about 50 weight percent of at least one vinyl monomer selected from the group consisting of a $C_1$ to $C_6$ alkyl (meth)acrylate, hydroxyalkyl (meth)acrylate, hydroxyaryl (meth)acrylate, alkoxyalkyl (meth)acrylate, polyalkoxyalkyl (meth)acrylate, styrene, vinyltoluene, alkyl vinyl ether, amino-substituted alkyl (meth)acrylate, amino-alkyl vinyl ethers, maleic anhydride, maleic acid, fumaric acid, itaconic acid, (meth)acrylic acid and the salts of maleic acid, fumaric acid, iraconic acid, and (meth)acrylic acid.

9. A fabric finishing composition, comprising:

(A) from about 0.1 to about 45 weight percent of at least one dye deposition inhibiting agent selected from the group consisting of:

(1) an acrylic carboxylate dispersant polymer comprising: (a) from about 70 to about 98 weight percent of at least one monoethylenically unsaturated carboxylic acid monomer selected from (meth)acrylic acid, itaconic acid, and aryloxypropionic acid, and salts thereof, and (b) from about 2 to about 30 weight percent of at least one $C_1$ to $C_4$ alkyl (meth)acrylate monomer and (2) a poly(amino acid); and B) from 99.9 to 55 weight percent of at least one additive selected from the group consisting of: a builder, buffering agent, bleaching agent, cellulase enzyme, surfactant different from the dye deposition inhibiting agent, fabric softener, solvent, inert diluent, stabilizer, perfume, opacifier, and solid forming agent.

10. The fabric finishing composition of claim 9 wherein the dye deposition inhibiting agent is poly(aspartic acid).

11. A process for preventing the deposition of a dye onto a fabric comprising:

1) forming an aqueous bath comprising a) water, b) dyed fabric, and c) at least one dye deposition inhibiting agent selected from the group consisting of: a polyethoxylated urethane, an aryl sulfonic acid condensate, an acrylic carboxylate dispersant polymer, an acrylamide containing polymer having a molecular weight from about 2,000 to about 500,000, a poly(amino acid), and an acrylic carboxylate emulsion polymer;

2) treating the dyed fabric in said aqueous bath and releasing a portion of the dye from the dyed fabric into said bath, and 3) substantially preventing the dye from redepositing on said dyed fabric by maintaining said dye inhibiting agent in contact with said dyed fabric and released dye for the duration of the treating step, said dye inhibiting agent in the aqueous bath being maintained at a concentration of from at least 25 to 2000 ppm based on the total weight of the aqueous bath excluding the weight of the dyed fabric.

12. The process of claim 11 wherein said treating step comprises both intentionally releasing a portion of said dye from said treated fabric and inadvertently releasing another portion of dye from said treated fabric, and where said dye deposition inhibitor agent is maintained in contact with said dye fabric during both dye releasing steps.

13. The process of claim 11 where said treating step comprises stonewashing.

14. The process of claim 11 where said treating step comprises prewashing.

15. The process of claim 11 where the dye is a vat dye.

16. The process of clam 11 where the dye is indigo blue.

17. The process of claim 11 where the dye is sulfur black.

18. The dyed fabric treated according to the process of claim 11.

19. An aqueous treatment solution for inhibiting the deposition of dye on fabric being treated in a fabric finishing process, comprising: 1) water and 2) the fabric finishing composition of claim 9, wherein the concentration of the dye deposition inhibiting agent in the aqueous treatment solution is from 25 to 2000 ppm by weight.

20. A fabric finishing composition, comprising:

(A) from about 0.1 to about 45 weight percent of at least one dye deposition inhibiting agent selected from the group consisting of:

(1) an aryl sulfonic acid condensate comprising an sulfonated reaction product of (a) at least one aldehyde, and (b) at least one aromatic containing compound, and wherein the condensate contains an aromatic nucleus having at least one sulfonic acid group attached thereto;

(2) an acrylic carboxylate dispersant polymer comprising: (a) from about 70 to about 98 weight percent of at least one monoethylenically unsaturated carboxylic acid monomer selected from (meth)acrylic acid, itaconic acid, and aryloxypropionic acid, and salts thereof, and (b) from about 2 to about 30 weight percent of at least one $C_1$ to $C_4$ alkyl (meth)acrylate monomer; and (3) a poly(amino acid); and B) from 99.9 to 55 weight percent of at least one additive selected from the group consisting of: a builder, buffering agent, bleaching agent, cellulase enzyme, surfactant different from the dye deposition inhibiting agent, fabric softener, solvent, inert diluent, stabilizer, perfume, opacifier, and solid forming agent.

21. An aqueous treatment solution for inhibiting the deposition of dye on fabric being treated in a fabric finishing process, comprising: 1) water and 2) the fabric finishing composition of claim 20, wherein the concentration of the dye deposition inhibiting agent in the aqueous treatment solution is from 25 to 2000 ppm by weight.

* * * * *